US011089397B2

(12) United States Patent
Schuler

(10) Patent No.: US 11,089,397 B2
(45) Date of Patent: Aug. 10, 2021

(54) MICROPHONE INTEGRATED ASSEMBLY USED IN MOTOR VEHICLE

(71) Applicant: VALEO INTERIOR CONTROLS (SHENZHEN) CO., LTD, Shenzhen (CN)

(72) Inventor: Stephane Schuler, Shenzhen (CN)

(73) Assignee: VALEO INTERIOR CONTROLS (SHENZHEN) CO., LTD, Shenzhen (CN)

( * ) Notice: Subject to any disclaimer, the term of this patent is extended or adjusted under 35 U.S.C. 154(b) by 0 days.

(21) Appl. No.: 16/606,917

(22) PCT Filed: Apr. 23, 2018

(86) PCT No.: PCT/CN2018/084033
§ 371 (c)(1),
(2) Date: Oct. 21, 2019

(87) PCT Pub. No.: WO2018/192586
PCT Pub. Date: Oct. 25, 2018

(65) Prior Publication Data

US 2020/0196040 A1 Jun. 18, 2020

(30) Foreign Application Priority Data

Apr. 21, 2017 (CN) ..... 201710266229.3

(51) Int. Cl.
*H04R 1/08* (2006.01)
*H04R 1/04* (2006.01)

(52) U.S. Cl.
CPC ..... *H04R 1/086* (2013.01); *H04R 1/04* (2013.01); *H04R 2201/029* (2013.01); *H04R 2499/13* (2013.01)

(58) Field of Classification Search
CPC .... H04R 1/086; H04R 1/04; H04R 2201/029; H04R 2499/13
(Continued)

(56) References Cited

U.S. PATENT DOCUMENTS 5,707,903 A * 1/1998 Schottenfeld ..... B32B 5/02 442/30
2003/0190825 A1* 10/2003 Sasaki ..... H01R 12/7076 439/66

(Continued)

FOREIGN PATENT DOCUMENTS

CN 101228669 A 7/2008
CN 103050852 A 4/2013
JP 2002075502 A 3/2002

OTHER PUBLICATIONS

International Search Report and Written Opinion issued in English for corresponding PCT Application No. PCT/CN2018/084033, dated Jul. 18, 2018 (7 Pages).

*Primary Examiner* — Vivian C Chin
*Assistant Examiner* — Con P Tran
(74) *Attorney, Agent, or Firm* — Osha Bergman Watanabe & Burton LLP

(57) ABSTRACT

This invention proposes a microphone integrated assembly used in a motor vehicle, which comprises a main application printed circuit board, a microphone printed circuit board implementing one or more microphones, and a compression type interconnector which is compressively assembled between the main application printed circuit board and the microphone printed circuit board such as to electrically connect the microphone printed circuit board and the main application printed circuit board. The compression type interconnector acts as an acoustic insulator, which mechanically decouple the microphone printed circuit board from the main application printed circuit board and prevents vibra- (Continued)

tions which source in the main application printed circuit board from coupling with the microphone printed circuit board, leading to decreased acoustic noise and improved microphone acoustic performance.

20 Claims, 3 Drawing Sheets

(58) Field of Classification Search
USPC .... 381/86, 71.4, 365, 122, 91, 92, 111, 355; 361/748, 761, 720, 736; 360/99.23, 360/99.24, 99.25
See application file for complete search history.

(56) References Cited

U.S. PATENT DOCUMENTS

| | | | | |
|---|---|---|---|---|
| 2008/0049848 | A1* | 2/2008 | Turnbull | B60R 11/0247 375/251 |
| 2016/0368382 | A1* | 12/2016 | Schlittenbauer | G06F 3/017 |
| 2020/0077211 | A1* | 3/2020 | Wichmann | H05K 1/181 |

* cited by examiner

MICROPHONE INTEGRATED ASSEMBLY USED IN MOTOR VEHICLE

TECHNICAL FIELD

The present invention relates to the integration of a microphone or microphone matrix into a vehicle interior module that is itself installed in a motor vehicle.

BACKGROUND

It is nowadays common to integrate one or several microphones in a motor vehicle for applications like hands-free telephony, voice recognition, noise pick up and/or e-Call. In general, microphones are integrated at predetermined locations in the vehicle cabin to pick up voice signal from occupants with the purpose of allowing voice source discrimination by triangulation and, that way, improving the sound quality and voice signal integrity of mobile communications. The usage of multiple microphones or microphone arrays or matrixes in vehicle is growing popular since it allows great background noise filtering performance compared to single microphone constructions.

So far, microphones have been integrated within a vehicle as standalone modules, namely, microphone with its own electronics, connectors and package is installed in the vehicle trim component (such as an instrument panel, a headliner or any other vehicle interior trim components) or into another larger vehicle electric/electronics interior module (such like an overhead console (OHC), a rear view mirror, or a central stack console and the like). In this case, the microphone and the larger electric/electronics module integrating this microphone do not share any component or function with the exception of their relative mechanical interface, namely the fixture of the one into the other one. This merely mechanical integration of microphones in an interior module causes various drawbacks, such as: creation of functional cost redundancies, limitation in integration and miniaturization, mechanical vibration transmitted across the mechanical interface leading to undesired noise for microphones, the structure of the interior module needing to be significantly altered to accommodate the integration of the microphones, and numerous parts increasing the manufacturing complexity. The reason behind this situation is mostly a legacy of the current supplier base: microphone suppliers are not suppliers of the larger module integrating them.

Furthermore, driven by cost reasons, original equipments manufacturers (OEMs) are increasingly demanding fully integrated system in which the integrated module and eventually software can centrally control all functions of the considered module for integration. Regarding the microphone related functions, it is highly desired to fully, namely mechanically and electrically, integrate one or more microphones in an interior module, in order to systematically and smartly control the microphone function as well as the existing functions carried on the interior module. For example but not limited, it is expected that the integrated module is a overhead console (OHC) module, which includes not only the OHC specific functions like ambient lamps, map lamps and/or various human machine interfaces (HMI), such as buttons, displays and the like, but also the microphone function.

The present invention aims to at least overcome the aforementioned technical problems in the prior art.

SUMMARY

The object of the present invention is to provide a microphone integrated assembly used in a motor vehicle to integrate microphone(s) in a larger vehicle interior module, which allows optimum acoustic performance, minor modifications to the structure of the interior module to mechanically integrate the microphone(s), and ease assembly operations. These and other objects are achieved by the embodiments of the invention having the features recited in the claims.

Microphones are preferably implemented on an individual microphone printed circuit board separated from the main application printed circuit board mainly for optimum acoustic performance, but in most of the cases it is also the consequence of different applicable physics laws for the microphone and main application printed circuit board functions. In the case of an overhead console, the microphone printed circuit board is to satisfy acoustic performance while the main application printed circuit board is to satisfy at least optical performance; compromising the printed circuit board level to allow same printed circuit board implementation for both microphone and main application components proves usually impossible. The first aspect of this invention proposes a microphone integrated assembly used in a motor vehicle, which comprises a main application printed circuit board, a microphone printed circuit board implementing one or more microphones, and a compression type interconnector which is compressively assembled between the main application printed circuit board and the microphone printed circuit board such as to electrically connect the microphone printed circuit board and the main application printed circuit board. In this way, microphones implemented on microphone printed circuit board and the main application printed circuit board are electrically integrated with each other, and are capable of sharing same power source, electrical elements and package. Therefore, the microphone function and other functions carried on the main application printed circuit board can be centrally controlled. Meanwhile, the compression type interconnector can act as an acoustic insulator, which mechanically decouple the microphone printed circuit board from the main application printed circuit board and prevents vibrations which propagate through the main application printed circuit board from coupling with the microphone printed circuit board, leading to decreased acoustic noise and overall improved acoustic performance.

In some embodiments, the one or more microphones may be acoustic sensors carrying out an acoustic sensing function. Further, the acoustic sensors may be Micro-electromechanical Systems (MEMSs). In this case, since MEMS-based acoustic sensors are much smaller sized than traditional microphones units, a compact and miniaturized overall structure for the microphone integrated assembly is obtained.

In some embodiments, the microphone printed circuit board may integrate several acoustic sensors forming a microphone matrix. In this case, since the microphone matrix (or array) allows an improved background noise filtering performance, the acoustic performance of the assembly is further 3*o* improved.

The acoustic sensors may be located on the top side or the bottom side of the microphone printed circuit board. When the acoustic sensors are located on the bottom side of the microphone printed circuit board, each of the sensors covers an acoustic hole arranged through the microphone printed circuit board. In this case, voice is propagated through the acoustic hole. Besides, with microphones located on the backside, the topside of the microphone printed circuit board has a nearly flat surface, which helps to evenly contact the abutting members, such as a cover or a foam part and prevent component damages.

In some embodiments, the compression type interconnector may be a carbon connector, which is cost efficient. In some other embodiments, the compression type interconnector may be a wire conductor type compression connector which uses highly conductive metal wires, such as Cu, Ag, or Au wires, to establish electrical paths between the microphone printed circuit board and the main application printed circuit board. The wire conductor type compression connector aims to lower resistance for improved electrical signal communication and increased power transfer between the printed circuit boards.

The microphone printed circuit board features a connecting pattern; and the main application printed circuit board features a connecting pattern. The compression type interconnector has its first conductive contacts electrically connected with the microphone printed circuit board connecting pattern and its second conductive contacts electrically connected with the main application printed circuit board connecting pattern, such that the microphone printed circuit board electrically connects to the main application printed circuit board. In this case, since connecting patterns, e.g. an array of connection pads, can be easily printed on a printed circuit board, the main application printed circuit board requires few modifications in structure, shape or size to adapt the integration of the microphone printed circuit board, except for the addition of connecting patterns at specific locations. Therefore, the microphone function can be easily integrated to the main application printed circuit board.

The compression type interconnector is mechanically aligned to electrically connect the microphone printed circuit board connecting pattern with the main application printed circuit board connecting pattern by compression. In this case, the compressed interconnector bias against the corresponding connecting patterns, resulting in a stable connection between the two printed circuit boards.

The assembly further comprises a housing enclosure located between the main application printed circuit board and the microphone printed circuit board which purpose is to correctly align the compression type interconnector at a location where the interconnector is capable of electrically connecting the microphone printed circuit board pattern with the main application printed circuit board pattern. In this case, once the housing enclosure is in position, the interconnector is accordingly located and maintained at a correct location to connect the two printed circuit boards. The housing enclosure is assembled first, followed by the placement of the compression interconnector into the enclosure. Thus, a non-blind and automated operation (such as stacking using robots) can be performed to assemble the microphone integrated assembly.

The assembly further comprises a cover including a mesh structure and/or holes. The mesh structure and/or holes are designed to minimize acoustic propagation interferences to the microphones implemented on the microphone printed circuit board.

The cover presses against the microphone printed circuit board towards the main application printed circuit board such that the compression type interconnector is compressed. In this case, the interconnector can be compressed by exerting a pressing force onto the cover, which is easily realized.

The main application printed circuit board is fastened by fastening means, such as screws, snapping means, and the like, to keep the compression type interconnector compressed in a stable way.

In some embodiments, the housing enclosure may be mechanically integrated with the cover.

The assembly further comprises a mesh foam part located between the cover and the microphone printed circuit board. The mesh foam part aids preventing dust from entering the microphone hole or affecting the microphone acoustic performance, and avoids a direct contact between the microphone printed circuit board and the cover, resulting in a further acoustic insulation to the microphone printed circuit board from its surroundings and leading to a further improved acoustic performance.

In some embodiments, the assembly may further comprise one or more additional compression type interconnectors, which are compressively assembled between the main application printed circuit board and the microphone printed circuit board to connect or simply to mechanically support the microphone printed circuit board. In this case, the additional compression type interconnector(s) may serve only the purpose of acoustic insulation without electrical contacting purpose. The number and position(s) of the additional interconnector(s) are not limited, and can be easily adjusted by those skilled in the art to adapt the specific geometries of microphone printed circuit boards, in order to support the microphone printed circuit boards at a proper location and without deflection or excessive stress.

In some embodiments, the microphone printed circuit board is located at a level close to the outward surface of the assembly; the main application printed circuit board is located at a different level; the difference between the two levels is compensated by the compression type interconnector. In this case, on one hand, microphones on the microphone printed circuit board can be located as close as possible to the top (outward) surface of the assembly for optimum acoustic performance. On the other hand, the main application printed circuit board located at a different level can follow constraints from other fields of physics for other functions that are carried out. Difference between the levels of the main application printed circuit board and the microphone printed circuit board can be compensated by the height of the compressively assembled interconnector, without any modification to the structure of the main application printed circuit board or the cover.

According to a second aspect of this invention, an interior module for a vehicle comprising the aforementioned assembly is provided. In this way, an interior module can integrate microphones to capture voices from discriminated occupants within a vehicle, and also can centrally control the microphones, together with other functions implemented in said interior module. Particularly, the interior module may be physically located at a location suitable to the acoustic purposes of the microphone.

Optionally, the interior module may be an overhead console (OHC) in which that microphones are integrated. Furthermore, the interior module may be a rear view mirror.

According to a third aspect of this invention, a vehicle comprising the aforementioned interior module is provided.

According to a fourth aspect of this invention, a method for assembling the aforementioned assembly is provided. The method comprising the steps of providing a microphone printed circuit board which implements one or more microphones; arranging a compression type interconnector on the microphone printed circuit board; and arranging a main application printed circuit board on the compression type interconnector. In this method, the compression type interconnector is compressively assembled between the microphone printed circuit board and the main application printed circuit board such as to electrically connect the microphone printed circuit board and the main application printed circuit board. This method comprises no blind operation and can be performed by simply stacking the members one-by-one. Then the method can be easily operated by a robot.

In some embodiments, the method further comprises arranging a housing enclosure between the microphone printed circuit board and the main application printed circuit board and arranging the compression type interconnector into the cavity of the housing enclosure. In this way, the compression type interconnector can be easily and correctly aligned at a location where the interconnector electrically connects the microphone printed circuit board with the main application printed circuit board.

In some embodiments, the compression type electrically connects the microphone printed circuit board with the main application printed circuit board thought a convenient and effective contacting method. In this case, the first conductive contacts of the compression type interconnector electrically contact a connecting pattern of the microphone printed circuit board, and the second conductive contacts of the compression type interconnector electrically contact a connecting pattern of the main application printed circuit board such that the microphone printed circuit board electrically connects to the main application printed circuit board.

In some embodiments, the method further comprising the step of pressing the main application printed circuit board towards the microphone printed circuit board in order to compress the compression type interconnector and to keep the compression type interconnector compressed. In this way, the compression deformation applied on the interconnector can be maintained reliably through the entire product lifecycle, and then a stable electrical connection between the two printed circuit boards can be obtained.

The aforementioned and other embodiments of the present specification are described in greater depth in the drawings and detailed description provided below.

BRIEF DESCRIPTION OF THE DRAWINGS

The present invention will be described, by way of example, with reference to the accompanying drawings, in which:

FIG. 4A-C represents 3 steps of the assembly process sequence, wherein:

FIG. 4A is the first step of the assembly process;

FIG. 4B is the second step of the assembly process;

FIG. 4C is the final step of the assembly process.

DETAILED DESCRIPTION OF THE EMBODIMENTS

In the accompanying drawings and the following description, identical or equivalent components are annotated by identical numbers. Numerous specific details are set forth in order to provide a better understanding of the invention. However, it will be apparent to one of ordinary skill in the art that the invention may be practiced without these specific details. In other instances, well-known features have not been described in detail to avoid obscuring the invention. Hereinbelow, an example in which the invention is applied to a motor vehicle will be described.

Figure 1:
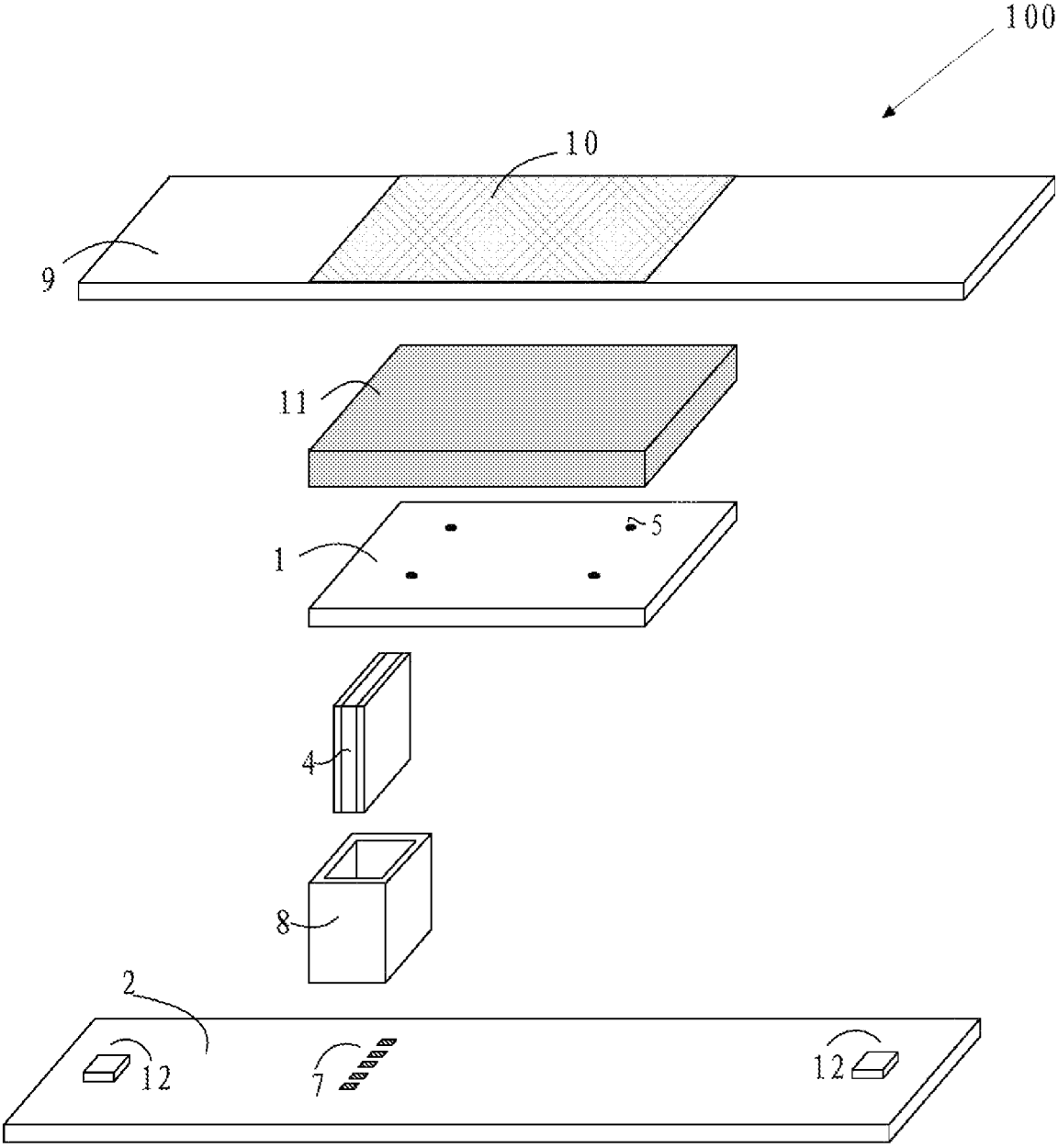
FIG. 1 is an exploded perspective view of a microphone integrated assembly according to one embodiment of the present invention.
Figure 2:
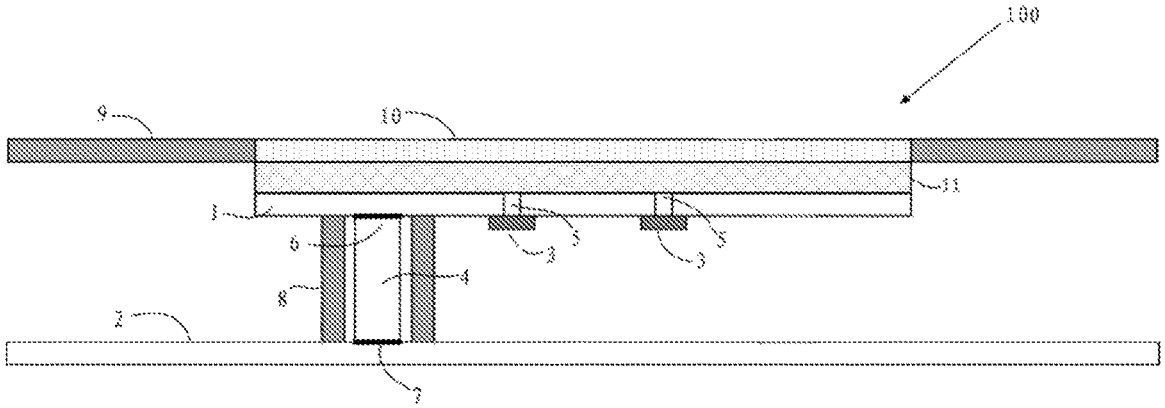
FIG. 2 is a cross-sectional view of the microphone integrated assembly shown in FIG. 1.

With reference to FIGS. 1-2, a description will be given of the structure of a microphone integrated assembly 100 according to one or more embodiments of the invention. FIG. 1 is an exploded perspective view of the microphone integrated assembly 100. FIG. 2 is a cross-sectional view of the microphone integrated assembly 100.

The microphone integrated assembly 100 is a portion of a microphone integrated overhead console (OHC) of a motor vehicle, in which the microphone function is integrated together with classic OHC functions. As shown in FIGS. 1-2, the assembly 100 mainly comprises a microphone printed circuit board assembly (printed circuit board) 1, a main application printed circuit board 2 and a compression type interconnector 4 compressively assembled between and electrically connecting the two printed circuit boards.

One or more microphones 3 are implemented on the microphone printed circuit board 1. Throughout this description, the term "microphones" refers to any suitable acoustic sensors capable of carrying out acoustic sensing functions, namely, capable of capturing sound pressure and converting it into electrical signals for subsequent processing. Preferably, the microphones 3 may be micro-electromechanical systems (MEMS), which contribute to a compact and miniaturized overall size for the assembly compared with the conventional microphone units. As shown in FIGS. 1 and 2, four microphones 3 are located on the bottom side (i.e. the side towards the main application printed circuit board 2) of the microphone printed circuit board 1. The four microphones 3 form a 2 by 2 microphone matrix in order to allow an improved background noise filtering performance capability. The microphone printed circuit board 1 is perforated by four acoustic holes 5. Each of acoustic holes 5 is covered by a respective microphone 3, such that sound pressure can propagate across the printed circuit board 1 and reach the respective microphone 3 located therebelow. In other embodiments not shown, the microphones 3 can also be located on the top side (i.e. the side opposites the main printed circuit board 2) of the microphone printed circuit board 1.

The main application printed circuit board 2 carries various elements for specific OHC functions, such as ambient lamps, map lamps and/or human machine interfaces. As schematically shown in FIG. 1, the main application printed circuit board 2 includes two LEDs 12, which are used for two map lamps. Various optical elements such as lenses and/or prisms (not shown) need to be integrated and located between the LEDs 12 and the outer surface of the assembly (e.g. the cover 9 shown in FIG. 1) for a specific optical performance. The optical elements usually require height over 10 mm, pushing the main application printed circuit board 2 backwards and deeper within the assembly, at a distance farther away from the outer surface of the assembly 100. It should be noted that the distance between the printed circuit boards may also be the result of other physical requirements. Phrased differently, while the microphone printed circuit board 1 level is to be defined as to satisfy the acoustic field of physics, the main application printed circuit board 2 is usually located at a different level to comply with optical or other physics fields constraints. Integrating microphones into a main application printed circuit board 2 of an OHC, though sometimes possible in the prior art, is hardly to be achieved successfully since the microphones require being located as close as possible to the outward surface of the assembly (e.g. the cover 9) for optimum acoustic performance.

Due to the issue described above, as shown in FIGS. 1-2, the microphones 3 are implemented on an individual microphone printed circuit board 1. The microphone printed circuit board 1 is located at some distance away from the main application printed circuit board 2. As a result, the microphone printed circuit board 1 with its microphones 3 can be located as close as possible to the cover 9 for optimum acoustic performance, while the main application printed circuit board 2 can be located at a deeper level to optimize the performance of the possible optical components. The interconnector 4 is used to compensate the difference of levels and electrically contact the two printed circuit boards with the shortest possible electrical connection. Advantageously, the microphone printed circuit board 1 is mechanically decoupled from the main application printed circuit board 2, preventing vibrations propagated along the larger printed circuit board 2 to further propagate to the microphone printed circuit board 1 carrying the acoustic sensors, thus reducing the noise picked up by the microphones 3. The size and shape of the microphone printed circuit board 1 can be designed according to the desired number and arrangement of the microphones 3 carried on the printed circuit board 1, without the need to consider the main application printed circuit board 2. Additionally, the compression interconnector 4 realizes the shortest possible connection between the two printed circuit boards. This feature can be advantageous in many cases when implementing microphone matrixes, since matrixes are usually connected to a master audio unit using a high speed digital bus.

In order to electrically integrate the microphone printed circuit board 1 and the main application printed circuit board 2, the assembly 100 uses the compression type interconnector 4 to electrically connect the printed circuit boards with each other. The interconnector 4 constructs multiple electrical paths, through which the main application printed circuit board 2 can provide electrical power and signals to and from the microphone printed circuit board 1 for its operation. The interconnector 4 can be used to connect the microphones 3 to a controller or a digital bus transceiver located on the main application printed circuit board 2. The controller or digital bus transceiver could also be located on the microphone printed circuit board 1 itself.

In the embodiments illustrated in FIG. 1 and FIG. 2, the microphone printed circuit board 1 features a connecting pattern 6 comprising multiple connecting pads printed on the bottom side of the printed circuit board 1. Correspondingly, the main application printed circuit board 2 features another connecting pattern 7 comprising another multiple connecting pads printed on the top side of the printed circuit board 2. The connecting patterns 6 and 7 are configured to mate with each other, namely, to build electrical path between the two printed circuit boards. Optionally, the pattern 6 and pattern 7 have the same size, shape and number of pads. However, it is also possible that the connecting pattern 6 is unequal to the connecting pattern 7. In order to connect the patterns 6 and 7, a contact-type connection is used. The connecting patterns 6 and 7 are connected by using a preferable compression type interconnector 4. As schematically shown in FIG. 1, the interconnector 4 comprises interlaced conductive portions and insulating portions. Each of conductive portions is exposed at the top and bottom contacts of the interconnector 4, and is used to contact a connecting pad in the pattern 6 and a respective connecting pad in the pattern 7, so as to build a continuous conductive path between these two pads. The insulating portions are used to insulate the conductive portions from each other to avoid short circuits within the interconnector 4. In this way, the patterns 6, 7 and therefore the printed circuit boards 1, 2 can be electrically connected with each other.

Any suitable contact-type interconnector known in the art can be used. For example, the interconnector 4 may be made from compressive materials, such as rubber. Then the interconnector 4 can be compressively assembled between the pattern 6 and pattern 7, as to electrically connect the microphone printed circuit board 1 and the main application printed circuit board 2 and get a stable contact connection. Conveniently, the interconnector 4 naturally compensates small relative displacements of the printed circuit boards and absorbs mechanical vibration propagating along the main application printed circuit board 2 resulting in a reduced noise picked up by the microphones 3 located on the microphone printed circuit board 1. The conductive portions of the interconnector 4 are made by adding conductive additives, such as carbon particles, metal wires and the like. Carbon type connectors having carbon particles are cost efficient, while wire conductor type connectors, which uses highly conductive metal wires such as Cu, Ag, Au wires and the like, can be used to establish much lower resistance electrical paths between printed circuit boards, such that a larger current can be allowed to flow through the interconnector 4.

As shown in FIGS. 1-2, the assembly 100 further comprises a housing enclosure 8 located between the microphone printed circuit board 1 and the main application printed circuit board 2. The housing enclosure 8 is configured to align the compression type interconnector 4 at its correct location. In the illustrated embodiment, the enclosure has a quadrangular box shape with a slot shaped through hole along the direction of height. The slot shaped hole is sized to receive the cubic interconnector 4, so as to locate the interconnector 4 at its proper location relative to the printed circuit boards and connecting patterns.

The assembly 100 further comprises a plastic cover 9, which is located on top of the microphone printed circuit board 1, such that the microphone printed circuit board 1 is protected from its surrounding and made invisible. The cover 9 is usually a styling part. A portion of the cover 9 is shown in FIGS. 1 and 2, which includes a mesh structure 10 having multiple holes. The mesh structure 10 is intended to cover the microphone printed circuit board 1 and is engineered as to minimize acoustic propagation interferences to the microphones implemented on the microphone printed circuit board 1. Further, the cover 9 pushes the microphone printed circuit board 1 toward the main application printed circuit board 2 in such a way that the compression type interconnector 4 is kept permanently compressed. In this embodiment, the main application printed circuit board 2 is fastened to the cover 9 by using fastening means (not shown), such as screws, snapping means, and the like, in order to keep the compression type interconnector 4 compressed. Preferably, but that is not mandatory, the housing enclosure 8 may be designed to mechanically integrate the cover 9.

The assembly 100 further comprises a mesh foam part 11, which is made from foam materials. The mesh foam part 11 is located between the cover 9 and the microphone printed circuit board 1, and serves the prevention of dust from entering the microphone hole and affecting the microphone acoustic performance. In the embodiments, the mesh foam part 11 is also compressive, such that the mesh foam part 11 can conform to any small relative displacement between the microphone printed circuit board 1 and the cover 9, and absorb vibration propagated therebetween.

Figure 3:
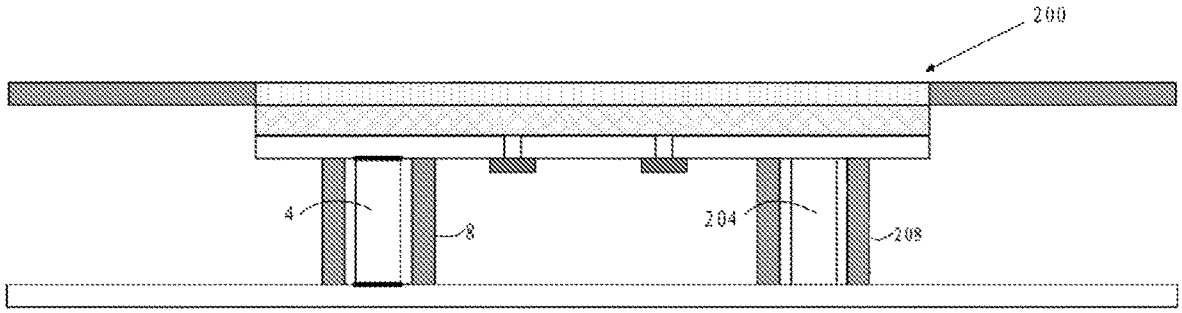
FIG. 3 is a cross-sectional view of a microphone integrated assembly according to another embodiment of the present invention.

FIG. 3 shows a microphone integrated assembly 200 according to another embodiment of this invention. The shown assembly 200 is the same like the assembly 100 shown in FIG. 2, except for the inclusion of an additional interconnector 204. In some embodiments, the additional interconnector may operates in a same way like the interconnector 4 as discussed above, namely being compressively assembled between the printed circuit boards as well as electrically connecting the patterns thereof. In the illustrated embodiment, the additional interconnector 204 may be compressively assembled between the main application printed circuit board 2 and the microphone printed circuit board 1, but without necessarily realizing an electrical connection between the printed circuit boards. In this latter configuration, the additional compression type interconnector 204 serves only the purpose of acoustic insulation. When used for electrical contacting purposes, the interconnector 204 may be the same carbon type or wire type interconnector including conductive features like the interconnector 4. When only used as an acoustic insulator, pure rubber interconnector without any conductive material may be used for reducing costs. In the illustrated embodiments, the interconnectors 4 and 204 have the same sizes and shapes, and are respectively located at two opposite edges of the main application printed circuit board 1. The sizes, shapes and locations of the interconnectors may vary with the versatility of designs. When assembled and compressed, the two interconnectors 4 and 204 deform uniformly, resulting in the microphone printed circuit board 1 to be supported at its correct location with a uniform compression force against the mesh foam part 11. The number and position(s) of the interconnector(s) are not limited to the one illustrated, and can be adjusted by those skilled in the art to accommodate the specific geometries of microphone printed circuit boards.

The invention can be carried out not only in the illustrative embodiments but also in other various embodiments. For example, while it has been shown that four microphones in a 2 by 2 matrix are implemented on the microphone printed circuit board 1, the invention is not limited thereto. It is also possible to employ different microphones configurations, the number of microphone and their arrangement on the printed circuit board 1 being irrelevant.

Similarly, while it has been exemplarily shown in the illustrative embodiments that the invention is applied to an overhead console, the invention is also applicable to any other interior modules in a motor vehicle, such as a rear view mirror, a central console and the like. The integrated microphones operate to capture voices from discriminated occupants within a vehicle, and can be centrally controlled together with other functions implemented in the interior module. The interior module is physically located at a location suitable for the acoustic purposes of the microphones.

Figure 4A:
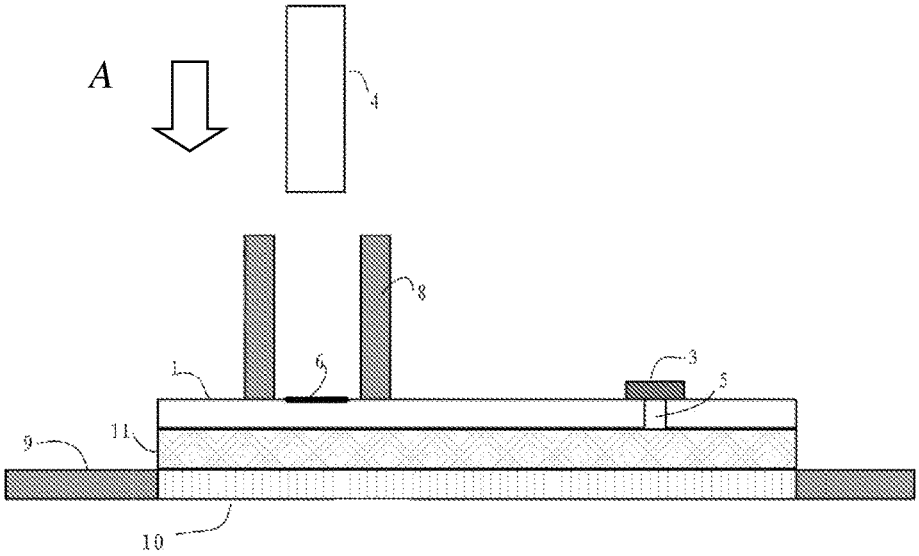
Figure 4B:
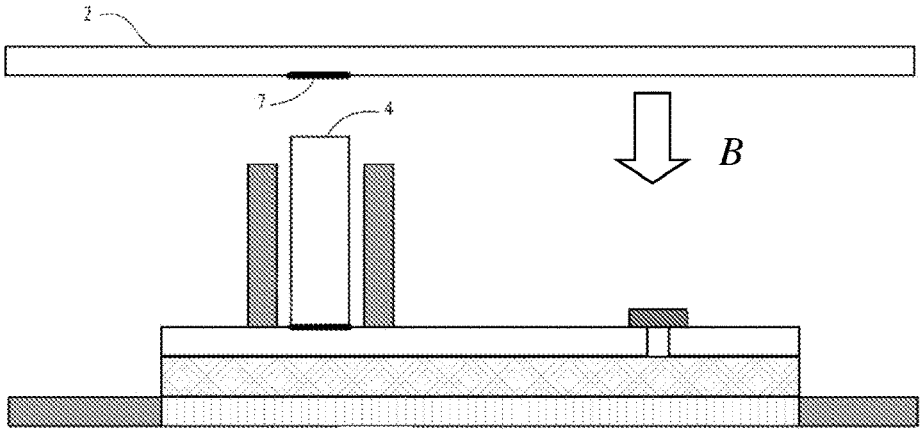
Figure 4C:
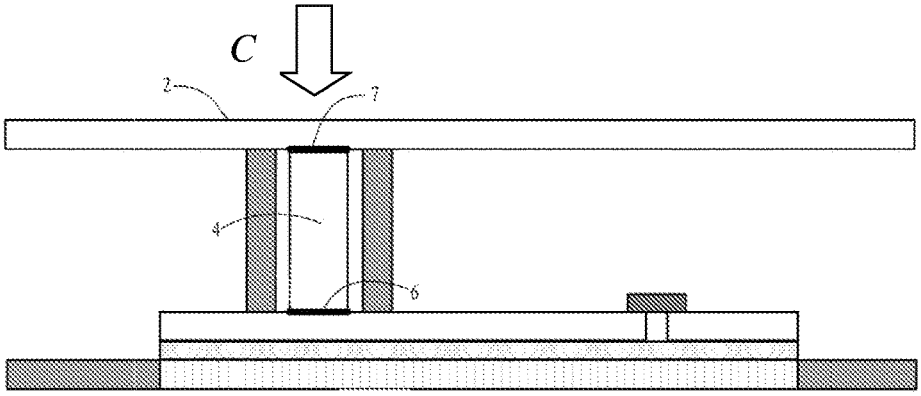

Referring to FIGS. 4A-C, a description will be given to the procedure of assembly. FIGS. 4A-C are each a view of a step of the assembly sequence.

FIG. 4A shows the foam part 11 and the microphone printed circuit board 1 stacked in sequence inside the cover 9, wherein the foam part 11 and the printed circuit board 1 are aligned to the mesh structure 10 of the cover 9. A housing enclosure 8 is then located to surround a connecting pattern 6 on the top side of the microphone printed circuit board 1. Optionally, the housing enclosure 8 may be a part integrated with the cover 9. Microphones 3 have been assembled on the top side of the printed circuit board 1 over their respective acoustic holes 5. As the arrow A shows, a compression type interconnector 4 is being placed inside the cavity of in the housing enclosure 8, in such a way that the bottom conductive contact of the interconnector 4 comes to contact the pattern 6 exposed in the enclosure 8. As shown in FIG. 4B, when the interconnector 4 is in position, the height of the un-compressed interconnector is higher than that of the enclosure 8.

As shown in FIG. 4B, a main application printed circuit board 2 is then being placed toward the interconnector 4 in the direction of arrow B. It should be noted that the main application printed circuit board 2 is located in such manner that the connecting pattern 7 on the bottom side thereof is aligned with the top conductive contact of the interconnector 4.

In the following step, as shown in FIG. 4C, a compression force is exerted on the top side of the main application printed circuit board 2, such that the interconnector 4 as well as the foam part 11 is compressed along the direction of the arrow C. As shown in FIGS. 4B and 4C, the heights of the interconnector 4 and the thickness of the foam part 11 are decreased after compression. A not shown fastening mean is used to tighten the assembly, such that the compression deformation applied on the interconnector 4 can be maintained reliably through the entire product lifecycle.

Finally, the assembled microphone integrated assembly is mounted onto a motor vehicle. The assembly process illustrated in FIG. 4A-C can be operated by stacking without any blind operation. Consequently, the assembly can be easily realized by robots, leading to a more accurate and productive process compared with manual operation.

While the assembling procedure has been exemplarily shown in an illustrative embodiment where only one compression type interconnector is used, the invention is applicable to multiple interconnectors, such as two interconnectors shown in FIG. 3. In the situation of an interconnector with only mechanical insulation purpose, the interconnector and the enclosure are located at a location that is best suited to support the printed circuit boards, rather than aligned with any connecting pattern of the printed circuit boards.

While the invention has been described with reference to a limited number of embodiments, those skilled in the art, having benefit of this invention, will appreciate that other embodiments can be devised without departing from the scope of the invention as disclosed herein. Accordingly, the scope of the invention should be limited only by the attached claims.

The invention claimed is:

1. A microphone integrated assembly used in a motor vehicle, comprising:

a main application printed circuit board;

a microphone printed circuit board implementing one or more microphones; and a compression type interconnector which is compressively assembled between the main application printed circuit board and the microphone printed circuit board such as to electrically connect the microphone printed circuit board and the main application printed circuit board, wherein the compression type interconnector is an acoustic insulator that mechanically decouples the microphone printed circuit board from the main application printed circuit board and that prevents vibrations propagating through the main application printed circuit board from coupling with the microphone printed circuit board.

2. The assembly according to claim 1, wherein the one or more microphones are located either on a top side or a bottom side of the microphone printed circuit board.

3. The assembly according to claim 2, wherein one or more acoustic holes are arranged in the microphone printed circuit board, and each microphone is located on the bottom side of the microphone printed circuit board and covers an acoustic hole.

4. The assembly according to claim 1, wherein the compression type interconnector comprises carbon conductors or wire conductors.

5. The assembly according to claim 1, wherein:

the microphone printed circuit board features a microphone printed circuit board connecting pattern, the main application printed circuit board features a main application printed circuit board connecting pattern, and the compression type interconnector has its first conductive contacts electrically connected with the microphone printed circuit board connecting pattern and its second conductive contacts electrically connected with the main application printed circuit board connecting pattern, such that the microphone printed circuit board electrically connects to the main application printed circuit board.

6. The assembly according to claim 5, wherein the compression type interconnector is mechanically aligned to electrically connect the microphone printed circuit board connecting pattern with the main application printed circuit board connecting pattern by compression.

7. The assembly according to claim 5, further comprising: a housing enclosure which is located between the main application printed circuit board and the microphone printed circuit board to correctly align the compression type interconnector at a location where the interconnector is capable of electrically connecting the microphone printed circuit board connecting pattern with the main application printed circuit board connecting pattern.

8. The assembly according to claim 7, further comprising: a cover including a mesh structure and/or holes configured to minimize acoustic propagation interferences to the microphones implemented on the microphone printed circuit board.

9. The assembly according to claim 8, wherein the cover pushes against the microphone printed circuit board towards the main application printed circuit board keeping the compression type interconnector compressed.

10. The assembly according to claim 8, wherein the main application printed circuit board is fastened by fastening means to the cover to keep the compression type interconnector compressed.

11. The assembly according to claim 8, wherein the housing enclosure is mechanically integrated to the cover.

12. The assembly according to claim 8, further comprising a mesh foam part located between the cover and the microphone printed circuit board.

13. The assembly according to claim 1, further comprising: one or more additional compression type interconnectors, which are compressively assembled between the main application printed circuit board and the microphone printed circuit board to support the microphone printed circuit board.

14. An interior module for a motor vehicle, comprising a microphone integrated assembly for use in the motor vehicle, comprising:

a main application printed circuit board;

a microphone printed circuit board implementing one or more microphones; and a compression type interconnector which is compressively assembled between the main application printed circuit board and the microphone printed circuit board such as to electrically connect the microphone printed circuit board and the main application printed circuit board, wherein the compression type interconnector is an acoustic insulator that mechanically decouples the microphone printed circuit board from the main application printed circuit board and that prevents vibrations propagating through the main application printed circuit board from coupling with the microphone printed circuit board.

15. The interior module according to claim 14, wherein the interior module is an overhead console (OHC) module.

16. A motor vehicle comprising: the interior module according to claim 14.

17. A method for assembling a microphone integrated assembly, the method comprising:

providing a microphone printed circuit board which implements one or more microphones;

arranging a compression type interconnector in the microphone printed circuit board; and arranging a main application printed circuit board on the compression type interconnector, wherein the compression type interconnector is compressively assembled between the microphone printed circuit board and the main application printed circuit board such as to electrically connect the microphone printed circuit board and the main application printed circuit board, and wherein the compression type interconnector is an acoustic insulator that mechanically decouples the microphone printed circuit board from the main application printed circuit board and that prevents vibrations propagating through the main application printed circuit board from coupling with the microphone printed circuit board.

18. The method according to claim 17, further comprising:

arranging a housing enclosure between the microphone printed circuit board and the main application printed circuit board; and arranging the compression type interconnector into the housing enclosure such that the compression type interconnector is correctly aligned at a location where the interconnector electrically connects the microphone printed circuit board with the main application printed circuit board.

19. The method according to claim 17, wherein the first conductive contacts of the compression type interconnector electrically contact a connecting pattern of the microphone printed circuit board, and the second conductive contacts of the compression type interconnector electrically contact a connecting pattern of the main application printed circuit board, such that the microphone printed circuit board electrically connects to the main application printed circuit board.

20. The method according to claim 17, further comprising: pressing the main application printed circuit board towards the microphone printed circuit board to compress the compression type interconnector and to keep the compression type interconnector compressed.

* * * * *